US005901813A

United States Patent [19]

Orgal

[11] Patent Number: 5,901,813

[45] Date of Patent: May 11, 1999

[54] PHYSIOTHERAPEUTIC DEVICE

[76] Inventor: Daniel Orgal, P.O. Box 49, Shoeva, Israel, 90855

[21] Appl. No.: 08/854,707

[22] Filed: May 12, 1997

[51] Int. Cl.[6] ..... B66B 9/08

[52] U.S. Cl. ..... 187/200; 414/921

[58] Field of Search ..... 187/200, 201; 414/921, 540, 545; 280/166

[56] References Cited

U.S. PATENT DOCUMENTS 5,316,432 5/1994 Smalley et al. ..... 187/200

FOREIGN PATENT DOCUMENTS 094000373 11/1994 European Pat. Off. ..... 187/200

*Primary Examiner*—Kenneth Noland
*Attorney, Agent, or Firm*—Mark M. Friedman

[57] ABSTRACT

A physiotherapeutic device for ascent and decent of stairs to be used by professional physiotherapists, and a preferred embodiment to be used at home, in order to rehabilitate patients or maintain health and physical fitness, the device also being useful as a safe ladder for the elderly and those who suffer from physical handicaps, including a plurality of substantially longitudinal step members arranged adjacent to each other, a body pivotally attached to each of the step members and an elevator coupled to the axis. Additionally, the device may be used as an elevator or stair lift assisting handicapped and wheelchair ridden individuals to ascend or descend to or from one level to another. Alternatively, the device may be used to raise or lower heavy or bulky items from one level to another, especially in the home where such tasks are very tasking if done unaided.

17 Claims, 8 Drawing Sheets

PHYSIOTHERAPEUTIC DEVICE

FIELD AND BACKGROUND OF THE INVENTION

The present invention relates to a therapeutic device and, more particularly, to a physiotherapeutic device for exercising the ascent and descent of stairs to be used by professional physiotherapists, and a preferred embodiment to be used at home, in order to rehabilitate patients or maintain health and physical fitness; the device may also be utilized as a safe ladder for the elderly and those who suffer from certain physical handicaps.

Additionally, the device according to the present invention may be used as an elevator or stair lift assisting handicapped and wheelchair ridden individuals to ascend or descend to or from one level to another.

Alternatively, the device may be used to raise or lower heavy or bulky items from one level to another, especially in the home where such tasks are very tasking if done unaided.

Many patients require physiological rehabilitation for various reasons. These include, for example, victims of traffic accidents, patients who have suffered from a cardiac episode or underwent a cardiac medical procedure, as well as individuals that have had a cerebral episode, invasive medical procedures, or sustained injuries of violence and the like. These patients need to receive physiotherapeutic treatment in rehabilitation wards of various institutes or by professional physiotherapists, for the purpose of a gradual return to regular life.

The practicing of ascending and descending stairs is a central part of the rehabilitation process and greatly assists in enabling the patient in returning to his natural environment. Furthermore, the ability to ascend and descend stairs is a vital component in the assessment process performed by the medical staff in relation to the possibility of discharging a patient from the rehabilitative institution to his home.

Notwithstanding the aforesaid, there are no efficient devices for performing this essential exercise. The rehabilitative institutes usually utilize a staircase made of wood with three to five stairs of a fixed height. Such staircases do not meet the rehabiltatory needs of most patients as a patient at the start of the rehabilitation process may only be able to ascend stairs with a maximum height of, for example, 3 centimeters, while the same patient or a different patient at the end of the rehabilitation process, may require to exercise ascending and descending steps as high as 25 centimeters.

Many patients need to continue the rehabilitation process at home, after being discharged from the rehabilitative institute. As many researches show, exercising ascending and descending stairs aids health and physical fitness in general. This is especially the case for older patients.

Numerous house accidents are caused by falling off a ladder, and researches also show an increase in such a risk with age. Elderly people find it very hard to ascend a conventional ladder and therefore require a device enabling them to safely and easily ascend and reach the desired height and then descend from it, for the purpose of executing various activities in the home, such as inserting and removing items from cupboards or closets, light chores about the house, and the like. Such a device will open before the elderly and handicapped a wide range of activities which they previously were unable to perform for fear of the dangers involved with climbing ladders and the like or in a case where individuals are physically unable to use a conventional ladder.

Every physiotherapeutic device in professional and rehabilitative physiotherapy institutes is used by many patients. Efficiency, speed and convenience in adapting the device to meet the therapeutic needs of every patient are vital. The price and the dimensions of the device, however, are of secondary importance in that the burden of the overall cost is spread over many patients, and the device has a permanent place in the rehabilitative physiotherapy framework.

Physiotherapeutic treatment as described above is not usually available for patients that have been discharged to their homes, patients not needing to be admitted to a rehabilitative institution, and geriatrics not within an institutionalized framework, who require physiotherapy or physical exercise.

The mobility problem and the dangers of using a conventional ladder in the home are especially felt by the geriatric and the handicapped. For the handicapped, the use of a conventional ladder is both difficult and hazardous. Moreover, for these individuals the overall size and cost of the device are of primary significance in that it serves an individual, or couple, and the space available to use such a device is limited.

Various attempts have been made to create a device meeting the needs of the patients. In rehabilitative institutes wooden stairs are usually ordered from a carpenter. However, wooden stairs are latently deficient in that the stairs have a fixed height which can not be varied to meet the rehabilitation needs of every patient. In addition, there are patients in the preliminary stages of rehabilitation that are only able to exercise ascending and descending of stairs of a small height but in that the stairs are fixed at a larger height, are unable to accomplish this exercise.

Various fitness clubs have "stepping machines" which include a pair of paddles which go up and down on a hinge, while resistance is provided by pneumatic or hydraulic piston. These machines are unsuitable for the majority of patients, and especially unsuitable for the preliminary stages of rehabilitation. Moreover, "stepping machines" are intended to strengthen the user's muscles and are devoid of any rehabilitative use as well as involving different biomechanics than ascent and/or descent of stairs notwithstanding the term "stepping machines".

The use of conventional steps is inappropriate for the required physiotherapeutic exercise required in that the height of the steps cannot be altered. In addition, conventional ladders are manifestly hazardous for geriatrics and patients due to conventional ladders having a fixed height difference between each step as well as the lack of hand rails and latent instability of conventional ladders.

There is thus a widely recognized need for, and it would be highly advantageous to have, a low cost, low maintenance, reliable and effective physiotherapeutic device for the exercising of ascent and decent of stairs which provides a quick, easy and exact adaptation to the needs of the patient; the device enabling a plurality of patients to perform ascents and descents, at varying degrees of difficulty, one after the other, and providing an effective rehabilitation device which may be used to aid in the maintaining of health and fitness or as a ladder for the elderly and handicapped.

Additionally, the is also a need for an elevator or stair lift assisting handicapped and wheelchair ridden individuals to ascend or descend to or from one level to another which can alternatively be used to raise or lower heavy or bulky items from one level to another, especially in the home where such tasks are very tasking if done unaided.

SUMMARY OF THE INVENTION

According to the present invention there is provided a physiotherapeutic device for ascent and descent of stairs, including: (a) a plurality of substantially longitudinal step members arranged adjacent to each other; (b) a body pivotally attached to each of the step members; and (c) an elevator coupled to the body.

According to further features in preferred embodiments of the invention described below, the device further includes an actuator for the elevator.

According to still further features in preferred embodiments of the invention described below, the device freer includes a controller attached to the device.

According to further features in preferred embodiments of the invention described below, the actuator is electrically operated.

According to still further features in the described preferred embodiments the device further includes: (a) two guard rails set above the step members; (b) a stop bar parallel to the step members and set above an end of the device; (c) a vertical shaft rotationally coupled to the actuator; (d) a toothed wheel attached to the vertical shaft; (e) a complementary tapped fixture on the vertical shaft and attached to the body; and (f) a ramp attached to the step member substantially at the opposite side of the device in relation to the vertical shaft.

According to yet further features in preferred embodiments of the invention described below, the device further includes a transverse rail above the step members.

According to still further features in preferred embodiments of the invention described below, the device her includes a rail parallel to the step members and set above an end of the device. According to the present invention there is provided a physiotherapeutic device for ascent and descent of stairs, including: (a) a plurality of substantially longitudinal step members arranged adjacent to each other; (b) a plurality of posts pivotally attached to each of the step members; and (c) an actuator for displacing the posts to and from an angle substantially vertical to the step member on which the device is situated.

The present invention successfully addresses the shortcomings of the presently known configurations by providing a low cost, low maintenance, reliable and effective physiotherapeutic device for the exercising of ascent and decent of stairs which provide a quick, easy and exact adaptation to the needs of the patient as well as varying the height between adjacent stairs and creating any height difference required thereby facilitating an equal height difference between each two adjacent stairs; the device enabling a plurality of patients to perform ascents and descents, at varying degrees of difficulty, one after the other, and providing an effective rehabilitation device which may be used to aid in the maintaining of health and fitness or as a ladder for the elderly and handicapped.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a physiotherapeutic device which can be used to practice the ascent and descent of stairs and inclines.

The principles and operation of a physiotherapeutic device according to the present invention may be better understood with reference to the drawings and the accompanying description.

Figure 1:
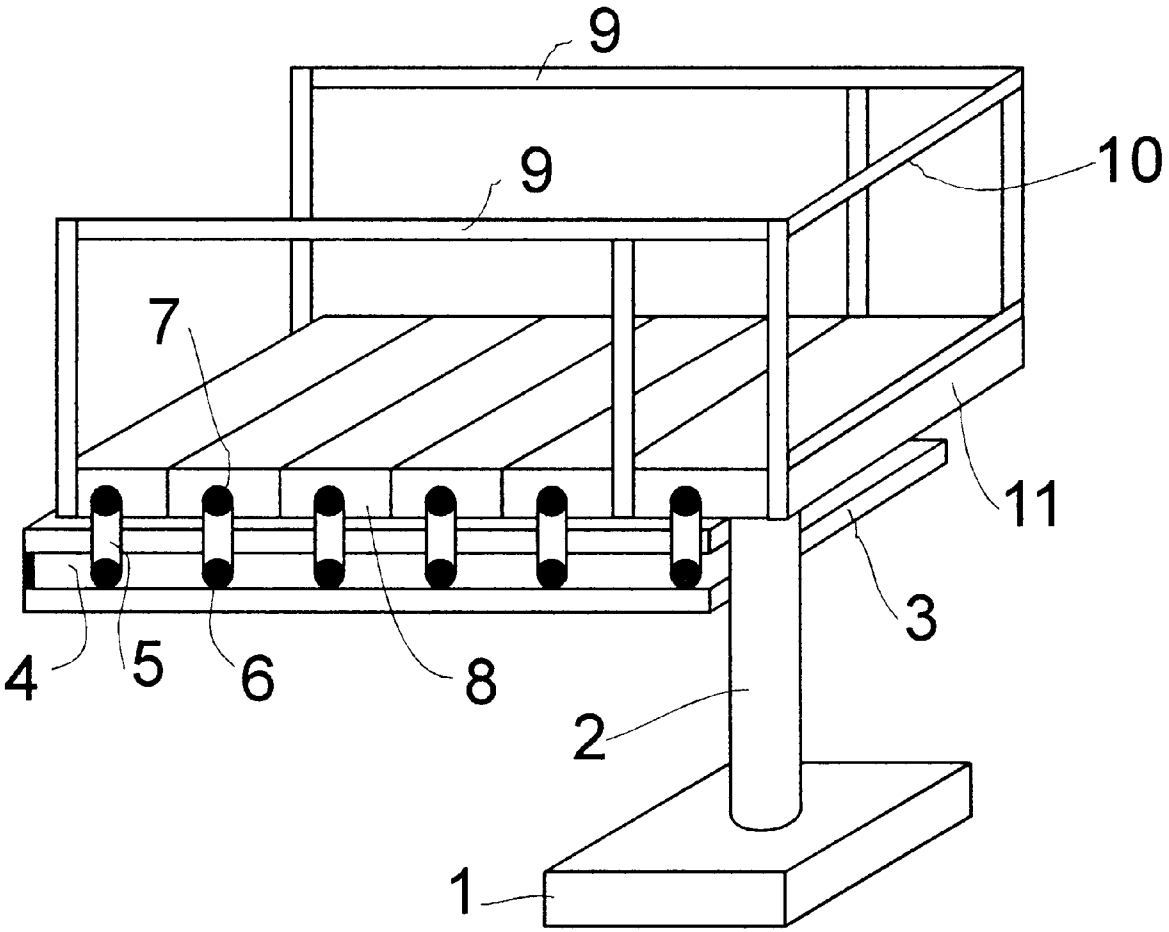
FIG. 1 is a perspective view of the device.

Referring now to the drawings, FIG. 1 illustrates the basic components of an illustrative embodiment of a device according to the present invention.

According to the present invention, the ascent and descent of stairs and inclines is practiced using a unique and novel device. A device according to the present invention includes a body 3, having an elevator 2, and actuator 1 attached to and situated beneath body 3.

Body 3 has a plurality of step members 8 pivotally mounted on posts 5. Posts 5, in turn, are also mounted on body 3.

Preferably, posts 5, are also pivotally freely mounted in a recess or rail 4, running along the longitude of body 3.

More preferably, step members 8 are five in number, flat and constructed of aluminum and covered by a non-slip surface.

Preferably, step member 8 most adjacent to elevator 2 is at least 50 centimeters in width.

Preferably, elevator 2 raises step members 8 coupled to body 3, creating a height difference of substantially 25 centimeters between each pair of adjacent step members 8.

Additionally and preferably, the user can raise elevator 2 to a sufficient height such that step members 8 create a height difference between 0–25 cm between adjacent step members 8.

Additionally, the device according to the present invention may be used as an elevator or stair lift assisting handicapped and wheelchair ridden individuals to ascend or descend to or from one level to another.

Alternatively, the device may be used to raise or lower heavy or bulky items from one level to another, especially in the home where such tasks are very tasking if done unaided.

Preferably, the device also includes a wide step member 11 situated at the end nearest to elevator 2, which wide step member 11 is wider than step members 8 or wide enough to enable an individual in a wheelchair to safely maneuver or rotate himself and the wheelchair while on wide step member 11.

The device according to the present invention, further includes a stop bar 10 to prevent a user or operator from fading off the edge of the device.

Preferably, the device further includes a pair of hand guard rails 9, to assist the users in maintaining their balance or supporting their weight while ascending or descending.

More preferably, guard rails 9 are arranged in a manner facilitating the practice of walking wherein the patient utilizes bars 9 to support his weight.

Preferably, guard rails 9 are transversely situated above step members 8.

Most preferably, guard rails 9 can be displaced manually or otherwise facilitating a change in the height of guard rails 9 above step members 8 or alternatively or additionally to change the distance between guard rails 9 thereby enabling a wide range of individuals having differing physical attributes to comfortably use the device.

Figure 2:
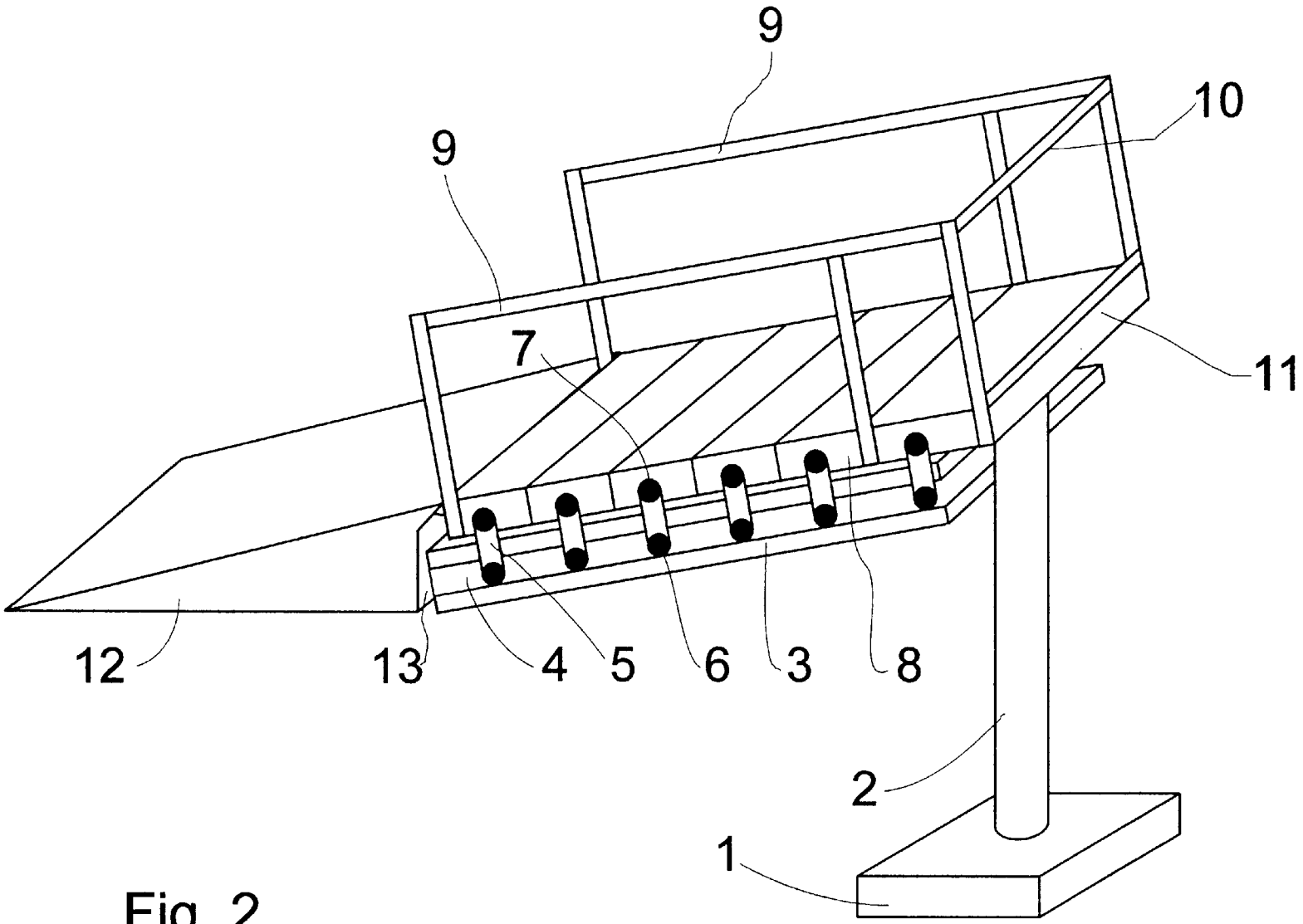
FIG. 2 is a perspective view of the device further including a ramp.

Another possible configuration is shown in FIG. 2, wherein the device includes a ramp 12, facilitating easier mounting and dismounting of the device without having recourse to excavate the intended installation location in order to provide a continuous step member to mount or dismount the device due to a patient being unable to climb any conventional step prior to reaching the point where the exercise will start.

Additionally, the device according to the present invention may be used as an elevator or stair lift assisting handicapped and wheelchair ridden individuals to ascend or descend to or from one level to another.

Alternatively, the device may be used to raise or lower heavy or bulky items from one level to another, especially in the home where such tasks are very tasking if done unaided.

Preferably, the device also includes a wide step member 11 situated at the end nearest to elevator 2, which wide step member 11 is wider than step members 8 or wide enough to enable an individual in a wheelchair to safely maneuver or rotate himself and the wheelchair while on wide step member 11.

More preferably, guard rails 9 can be displaced manually or otherwise facilitating a change in the height of guard rails 9 above step members 8 or alternatively or additionally to change the distance between guard rails 9 thereby enabling a wide range of individuals having differing physical attributes to comfortably use the device.

Figure 3:
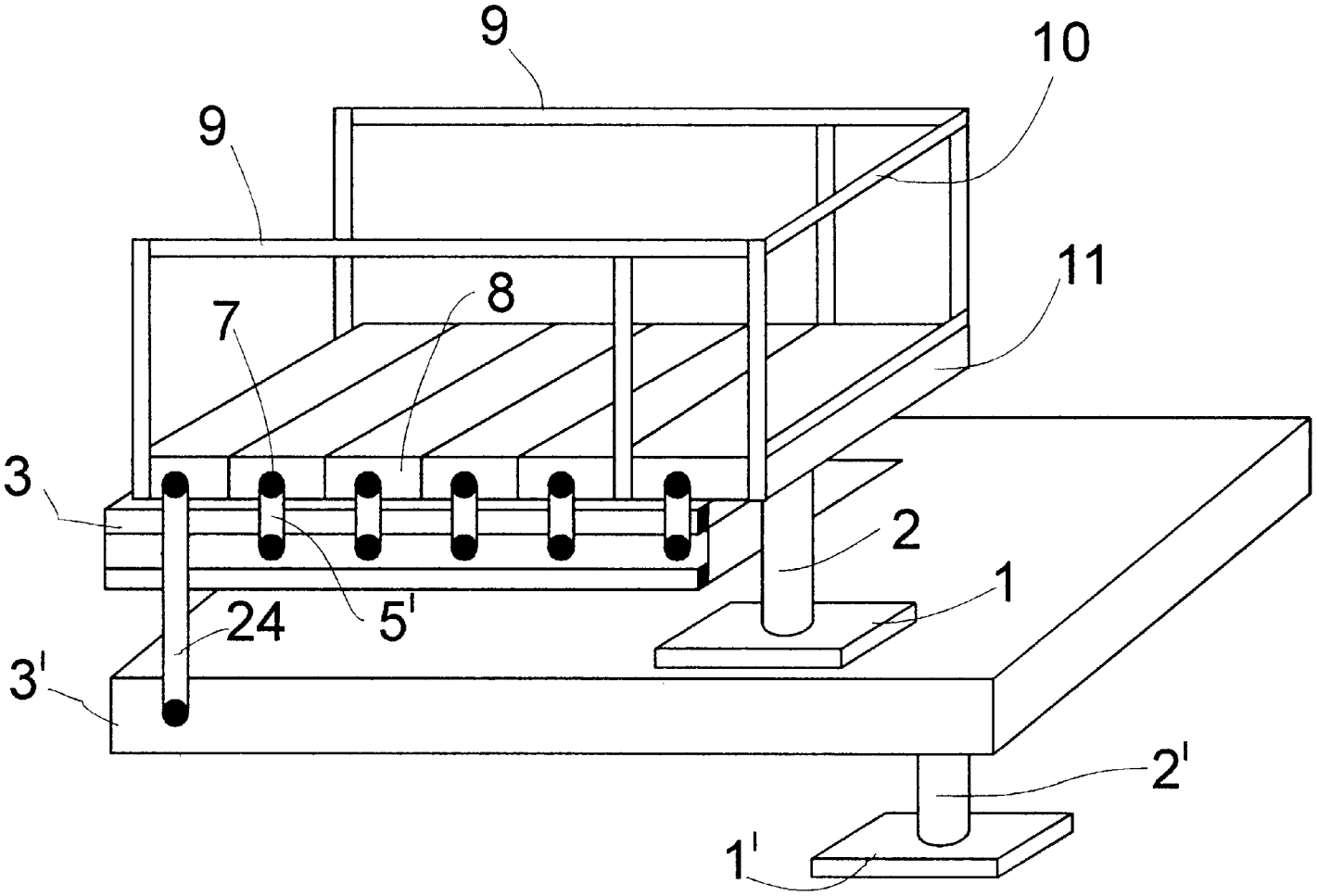
FIG. 3 is a perspective view of an alterative design of the device having an element which actually displaces all the elements above the body of the device.

Yet another configuration is shown in FIG. 3, wherein the device features a further actuator 1', a further elevator 2' and a second body 3' located beneath actuator 2, elevator 2 and body 3. Second body 3' raises all the elements above body 39 creating a variable incline of step members 8.

Actuator 1' may be operated with a variety of power sources including, but not limited to, electrical, hydraulic and pneumatic actuators 1'.

Preferably, actuator 1' is electrically operated.

Elevator 2 may be also be operated with a variety of power sources including, but not limited to, electrical, hydraulic and pneumatic elevators 2.

Alternatively, actuator 1 powers both elevator 2 and elevator 2'.

A further alternative (not shown) is to uncouple elevator 2 from step member 8 and couple elevator 2 to body 3 thereby alleviating the need for further actuator 1', further elevator 2' and second body 3'.

The device as shown in FIG. 3 also includes a post 24 hingedly attached to second body 39 at the end substantially opposite elevator 2 thereby creating a fulcrum which aligns step members 8 perpendicular to each other as well as parallel to the ground.

Additionally and preferably, the device also includes a wide step member 11 situated at the end nearest to elevator 2, which wide step member 11 is wider than step members 8 or wide enough to enable an individual in a wheelchair to safely maneuver or rotate himself and the wheelchair while on wide step member 11.

Also preferably, step members 8 are arranged adjacent to each other having first body 3 pivotally attached to each of step members 8 and elevator 2 is coupled to wide step 11.

Figure 4:
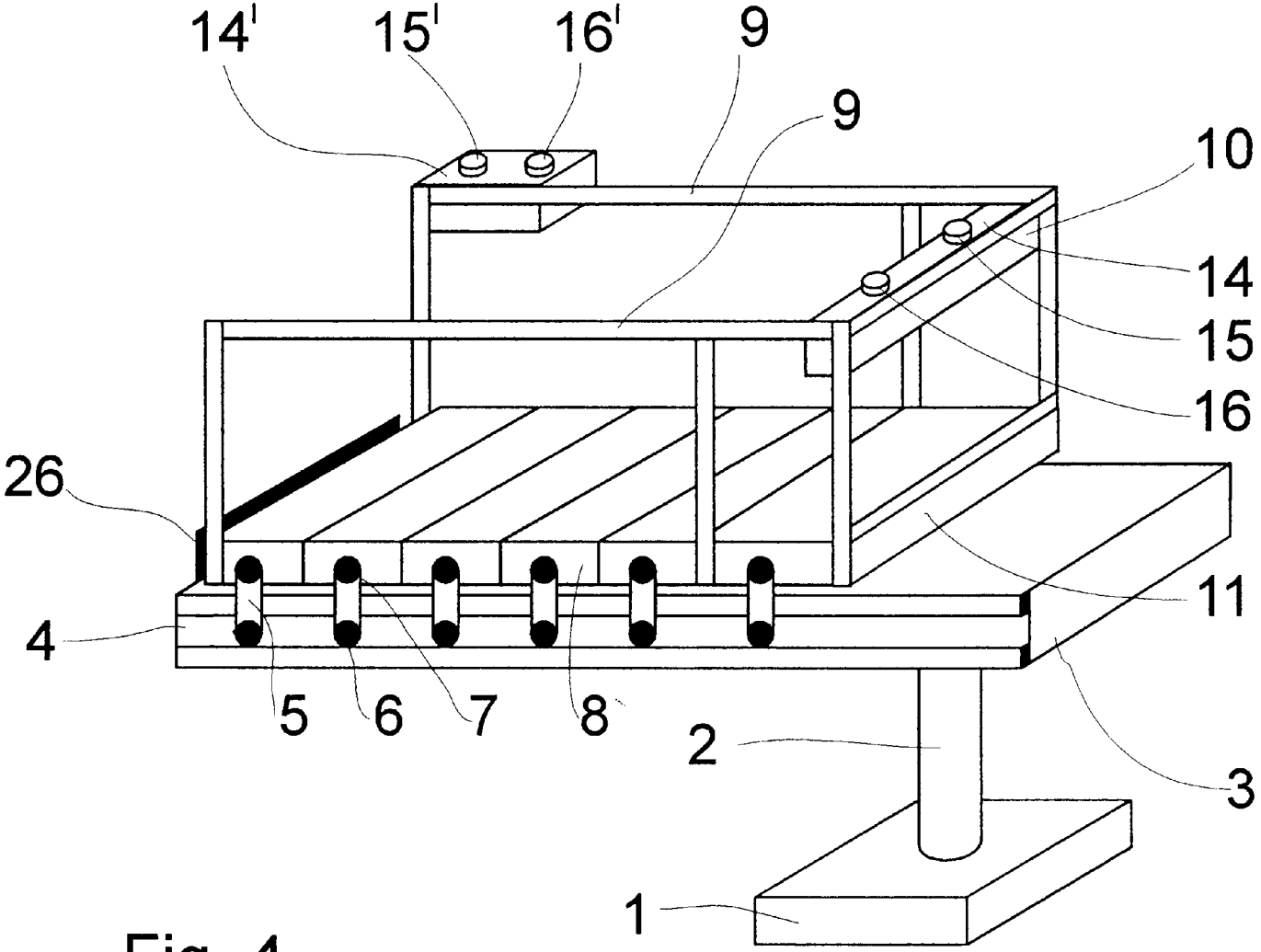
FIG. 4 is a perspective view of an alternative design of the device having an element which enables the operator to control the inclination of the device in relation to the step member is situated upon.

Yet another configuration can be seen in FIG. 4, wherein the device includes a controller 14, situated in the vicinity of stop bar 10 and includes an ascending activating member 15 which when activated, increases the incline of the device and descending activating member 16 which when depressed, decrease the incline of the device.

Preferably, the device also includes a fixer controller 14', situated in the vicinity of end furthest from stop bar 10 and includes an ascending activating member 15' which when activated, increases the incline of the device and descending activating member 16' which when depressed, decrease the incline of the device.

Often, different types of injuries prevent a wide range of movement and therefore can require to practice a specific type of bio-mechanic procedure such as ascents or descents only. For the purpose of exercising ascents only, the patient depresses ascending activating member 15 and increases the incline to the desired level, where the patient proceeds to ascend to the opposite end of the device. Upon reaching the other end, he depresses descending activating member 16' until step members 8 create a substantially flat surface and proceed to descend down the flat surface. The patient then walks back to the point where he started his ascent and repeats the procedure as necessary.

As explained hereinabove, different types of injuries often prevent a wide range of movement and therefore can require to practice a specific type of bio-mechanic procedure such as ascents or descents only. For the purpose of exercising descents only, the patient depresses descending activating member 16 until step members 8 create a substantially flat surface, where he proceeds to the opposite end of the device. The patient then depresses ascending activating member 15' and increases the incline to the desired level where the patient proceeds to descend to the opposite end of the device and repeats the procedure as necessary.

The device as shown in FIG. 4 also includes a plate 26 which prevents displacing step members 8 beyond the lower end of rail 4 as well as aligning step members 8 by creating a fulcrum which aligns step members 8 perpendicular to each other as well as parallel to the ground.

Figure 5:
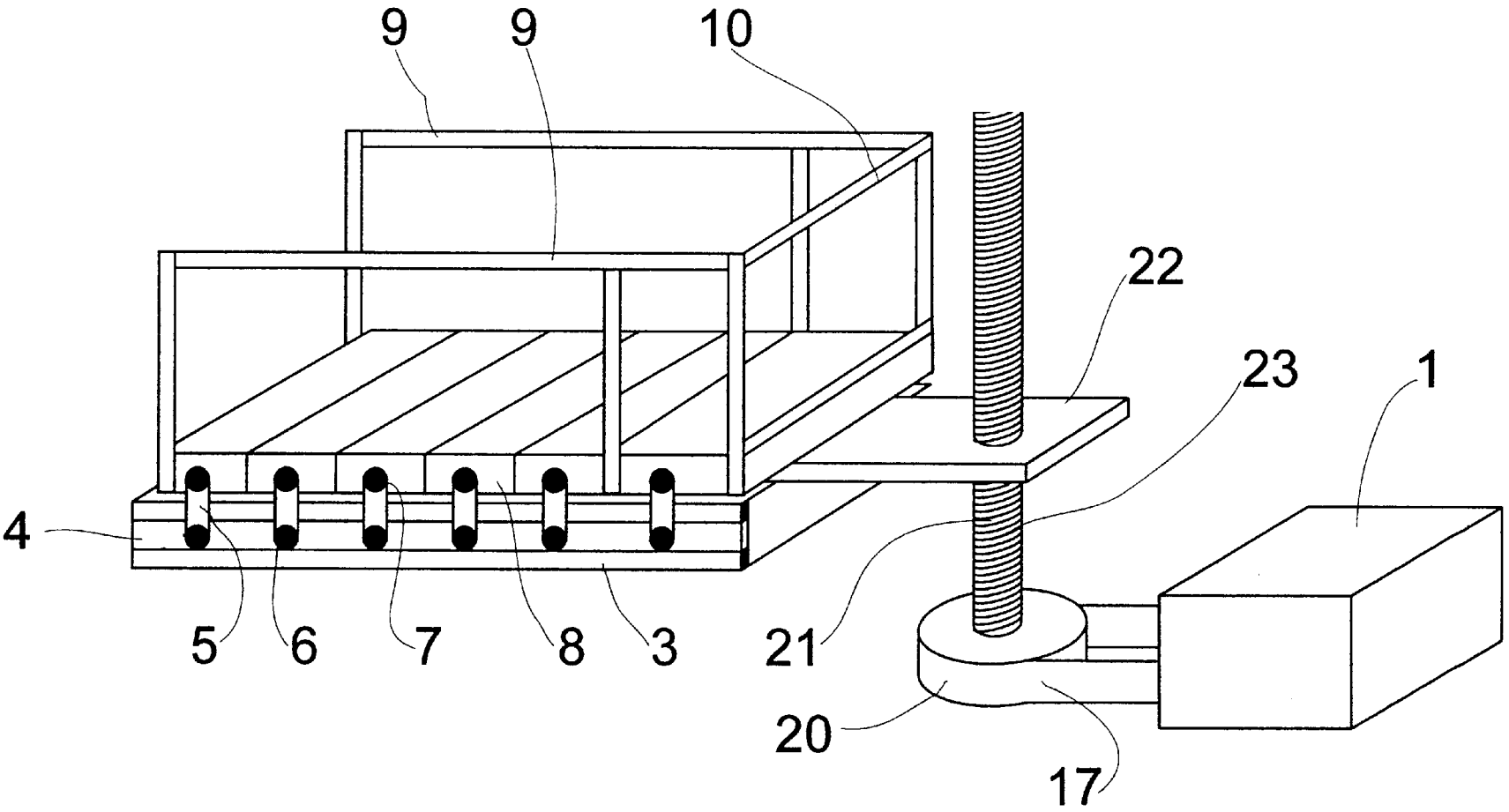
FIG. 5 is a perspective view of a further alternative design of the device having an element which turns a wheel which, in turn, includes a vertical shaft attached thereto, the vertical shaft is Her includes being tapped to accommodate a complementary threaded plate affixed to the device axis.

Another configuration can be seen in FIG. 5, wherein the device includes a substantially vertical tapped shaft 22 coupled to, directly or indirectly, or integrally formed with, a cog 20 which is powered by a belt 17 connected to actuator 1.

Preferably, the device according to the present invention further includes two guard rails 9 set above step members 8 and stop bar 10 is parallel to step members 8 and set above an end of the device.

More preferably, a device according to the present invention further includes vertical shaft 21 rotationally coupled to actuator 1. Vertical shaft 21 has cog 20 attached thereto. Cog 20 also has a plurality of teeth integrally formed therewith.

Furthermore, vertical shaft 21 has a complementary tapped fixture 22 attached to vertical shaft 21. Tapped fixture 22 also includes an aperture 23 formed therein and tapped fixture 22 is also attached to step member 8 nearest to actuator 1 or fixture 22, fixture 22 may alternatively be attached directly to body 3.

When Actuator 1 displaces belt 17 thereby rotating cog 20 which rotates vertical shaft 21 about its axis. The rotation of vertical shaft 21 having complementary tapped fixture 22 attached thereto thereby forces tapped fixture 22 to raise or lower depending on the direction of rotation. Thus fixture 22 when raised or lowered will raise or lower step member 8 attached to fixture 22 accordingly. Alternatively, when fixture 22 is attached to body 3, the rotation of vertical shaft 21 will result in a corresponding elevation of body 3.

Preferably, ramp 2 (not shown) is attached to step member 8 substantially at the opposite side of the device in relation to vertical shaft 21.

Alternatively, cog 20 has a plurality of teeth integrally formed therewith and belt 17 includes complementary ridges to engage cog 20.

Figure 6:
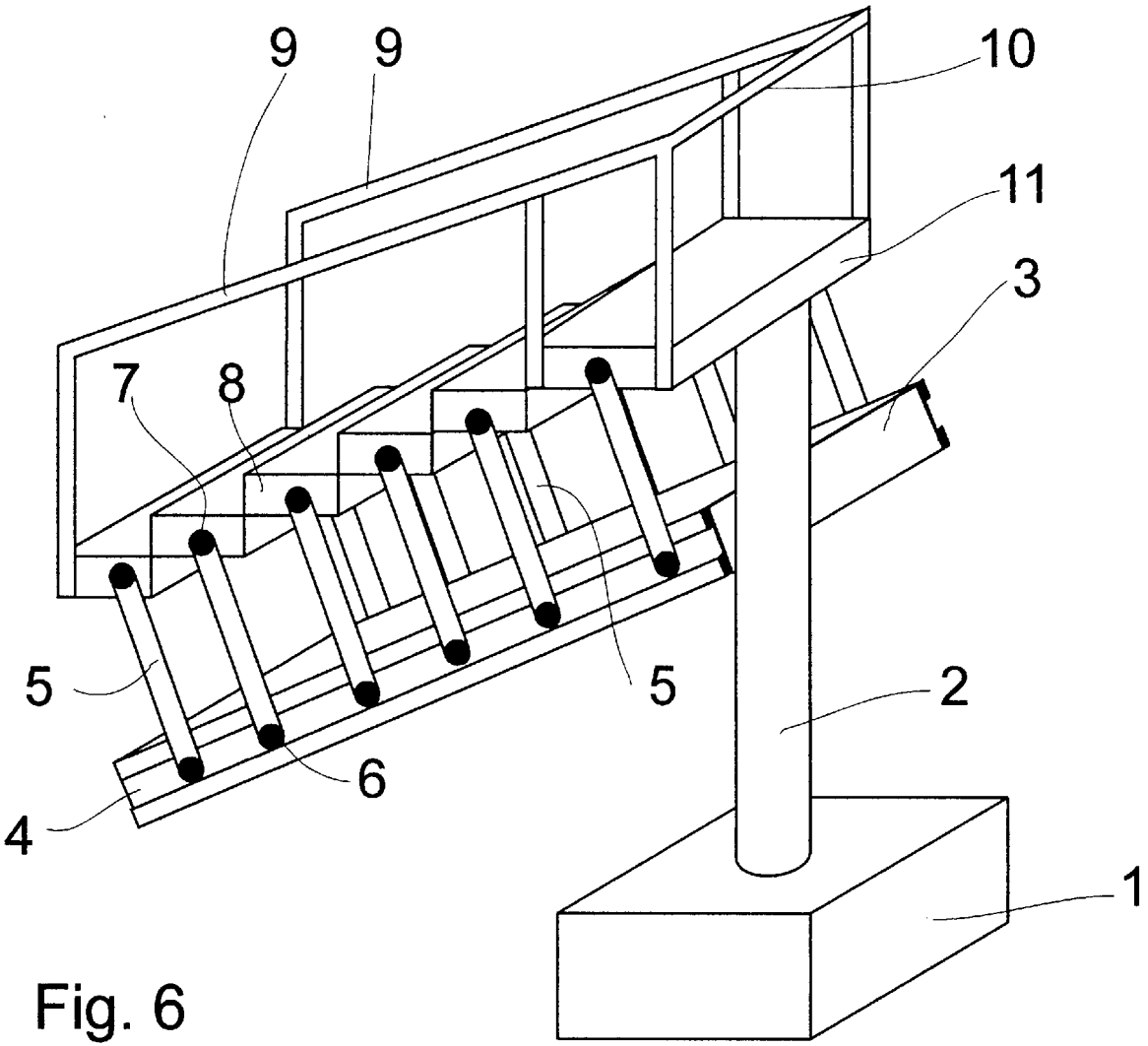
FIG. 6 is a perspective view of the device with the body raised.

Yet another configuration can be seen in FIG. 6, wherein the present invention similarly includes a body 3, having an elevator 2, and actuator 1 attached to and situated beneath body 3.

Like above, body 3 has a plurality of step members 8 pivotally mounted on posts 5. Posts 5, in turn, are also mounted on body 3.

Similarly, the device according to the present invention, further includes a stop bar 20 to prevent a user or operator from falling off the edge of the device.

Preferably, the device further includes a pair of hand guard rails 9, to assist the users in maintaining their balance or supporting their weight while ascending or descending.

More preferably, guard rails 9 are arranged in a manner facilitating the practice of waking wherein the patient utilizes bars 9 to support his weight.

Preferably, guard rails 9 are transversely situated above step members 8.

More preferably, posts 5, are also pivotally freely mounted in a recess or rail 4, running along the longitude of body 3.

Additionally and preferably, the device includes a post 5 on each side of step member 8, each of posts 5 are preferably also pivotally attached on both sides of body 3.

Most preferably, a lower pivot 6 on both sides of step member 8 is freely situated in a complementary recess or rail 4 which runs along body 3.

Additionally and preferably, the device also includes a wide step member 11 situated at the end nearest to elevator 2, which wide step member 11 is wider than step members 8 or wide enough to enable an individual in a wheelchair to safely maneuver or rotate himself and the wheelchair while on wide step member 11.

Furthermore, guard rails 9 can be displaced manually or otherwise facilitating a change in the height of guard rails 9 above step members 8 or alternatively or additionally to change the distance between guard rails 9 thereby enabling a wide range of individuals having differing physical attributes to comfortably use the device.

Figure 7:
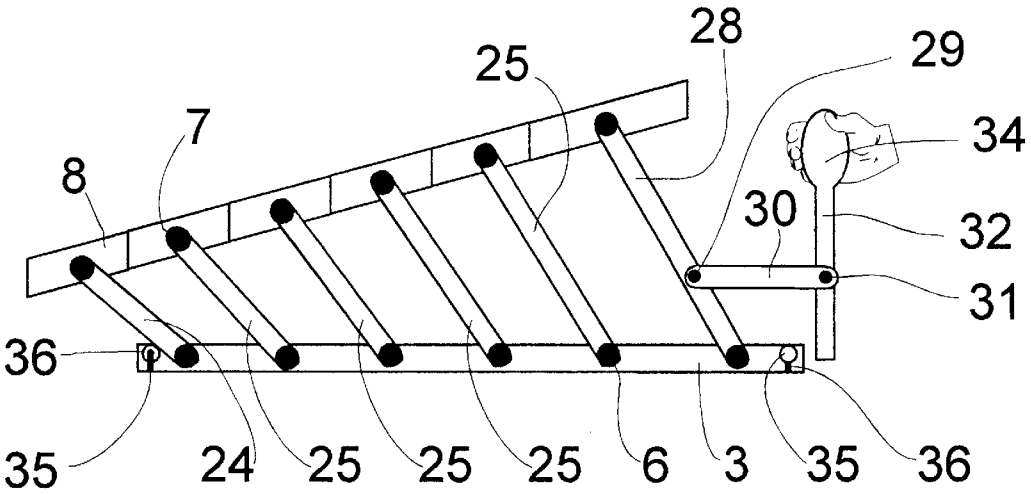
FIG. 7 is a side view of an alternative design of the device with the step members on a single plane.
Figure 8:
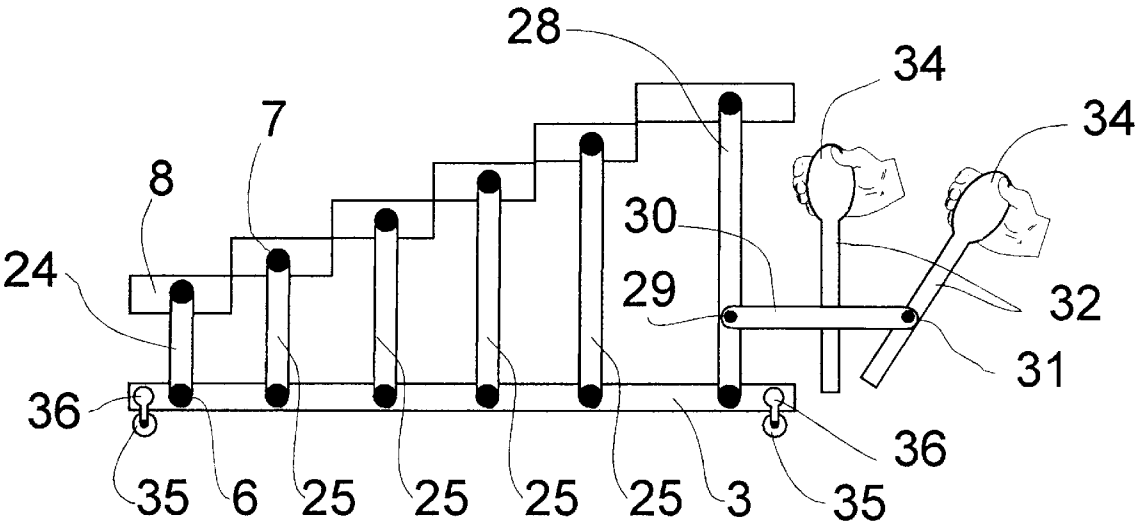
FIG. 8 is a side view of an alternative design of the device in the erect position.

Another configuration can be seen in FIGS. 7 and 8, wherein the device includes a short post 24 and a long post 28. Post 24 and post 28 are both pivotally attached to body 3 and step member 8 substantially above. Between short post 24 and long post 28 there are a plurality of posts 25 which are pivotally attached to body 3 and step member 8 above. Long post 28 is pivotally attached by a pivot 29 to a link bar 30. Link bar 30 is also pivotally attached to a handle 32 having a pivot 31. When handle 32 is displaced in a direction substantially away from body 3, link bar 30 is pivotally displaced accordingly which, in turn displaces long post 28 and thus alters the incline of step members 8.

Preferably, the device according to the present invention is collapsible for easy storage.

More preferably, the device according to the present invention further includes a wheel 35 collapsibly mouted on body 3. Wheel 35 has a complementary recess 36 to accommodate wheel 35 when wheel 35 is in the collapsed position.

Preferably, a device according to the present invention includes two sets of wheels 35 both forward and aft of the device facilitating easy maneuver of the device by a patient or elderly user.

More preferably, the device according to the present invention may be used as a ladder for the elderly to use in the home or as a device for practicing the ascent or descent of stairs or inclines in the home.

Figure 9:
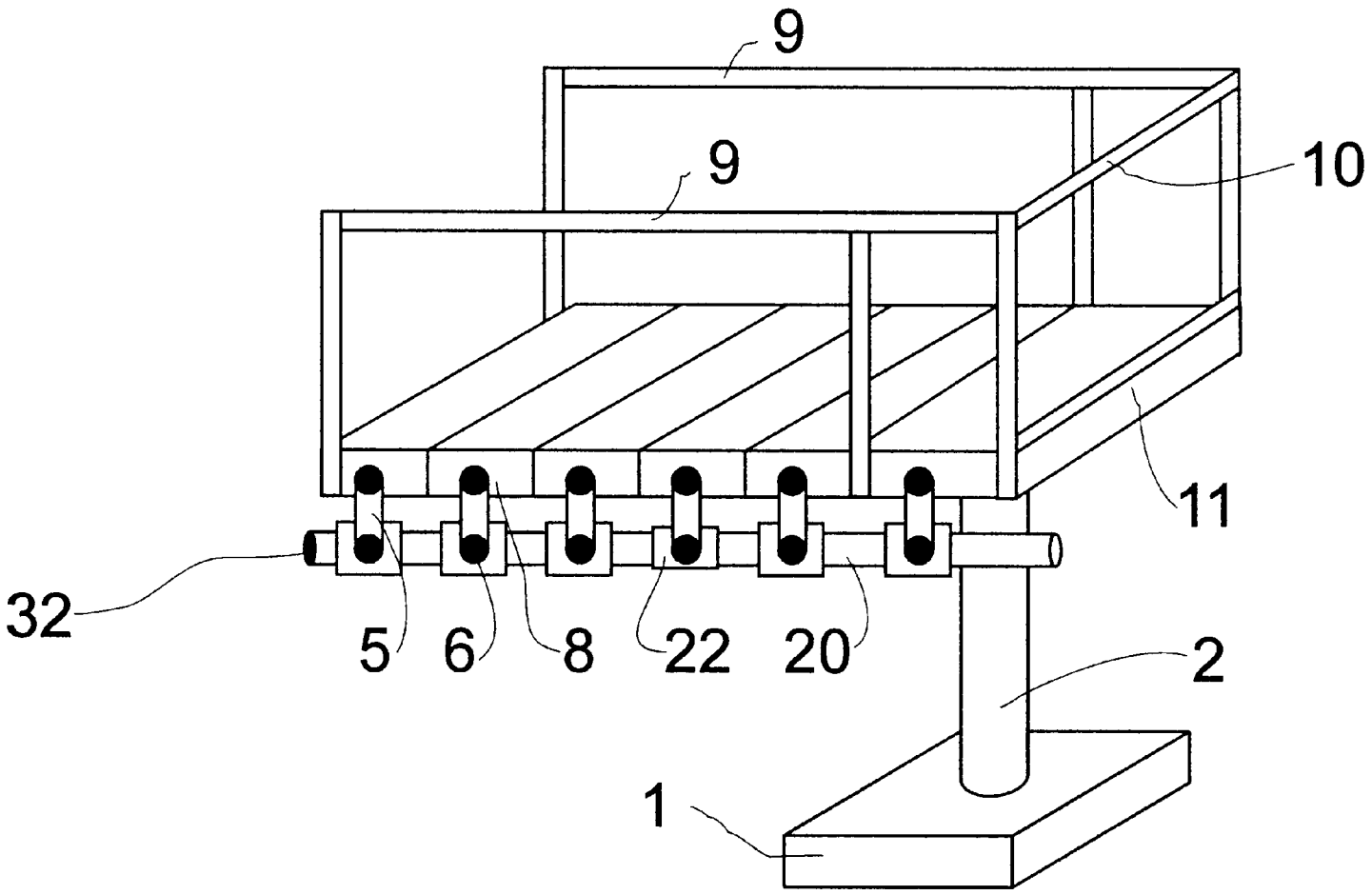
FIG. 9 is a perspective view of a preferred alternative design of the device.

According to yet another configuration shown in FIG. 9 there are similarly shown a plurality of step members 8, each of step members a being mounted on a sleeve 22. Sleeves 22 are themselves mounted on a pipe 20 hingedly attached to the ground at 32 which pipe 20 serves to align sleeves 22 and step members 8 attached to sleeves 22.

The configuration as shown in FIG. 9 similarly includes an elevator 2, and actuator 1 attached to and situated beneath a wide step member 11 situated at the end nearest to elevator 2, which wide step member 11 is wider than step members 8 or wide enough to enable an individual in a wheelchair to safely maneuver or rotate himself and the wheelchair while on wide step member 11.

Similarly, the device according to the present invention, further includes a stop bar 20 to prevent a user or operator from falling off the edge of the device.

Preferably, the device father includes a pair of hand guard rails 9, to assist the users in maintaining their balance or supporting their weight while ascending or descending.

More preferably, guard rails 9 are arranged in a manner facilitating the practice of walking wherein the patient utilizes bars 9 to support his weight.

Preferably, guard rails 9 are transversely situated above step members 8.

Additionally, the device according to the present invention may be used as an elevator or stair lift assisting handicapped and wheelchair ridden individuals to ascend or descend to or from one level to another.

Alternatively, the device may be used to raise or lower heavy or bulky items from one level to another, especially in the home where such tasks are very tasking if done unaided.

More preferably, guard rails 9 can be displaced manually or otherwise facilitating a change in the height of guard rails 9 above step members 8 or alternatively or additionally to change the distance between guard rails 9 thereby enabling a wide range of individuals having differing physical attributes to comfortably use the device.

While the invention has been described with respect to a limited number of embodiments, it will be appreciated that many variations, modifications and other applications of the invention may be made.

What is claimed is:

1. A device for ascent and descent of stairs, comprising:

(a) a plurality of substantially longitudinal step members arranged adjacent to each other;

(b) a body pivotally attached to each of said step members;

(c) an elevator coupled to said body;

(d) an actuator for said elevator, (e) two guard rails set above said step members;

(f) a stop bar parallel to said step members and set above an end of the device;

(g) a vertical shaft rotationally coupled to said actuator;

(h) a toothed wheel attached to said vertical shaft;

(i) a complementary tapped fixture on said vertical shaft and attached to said body; and (j) a ramp attached to the step member substantially at the opposite side of the device in relation to said vertical shaft.

2. The device of claim 1, further comprising a controller attached to the device.

3. The device of claim 1, wherein said actuator is electrically operated.

4. The device of claim 1, further comprising a transverse rail above said step members.

5. The device of claim 1, further comprising a rail parallel to said step members and set above an end of said device.

6. The device of claim 1, wherein said step members are flat and made of aluminum covered with an anti-slip covering.

7. The device of claim 1, wherein the step member most adjacent to said elevator is at least 50 centimeters in width.

8. The device of claim 1, wherein said elevator displaces said step members coupled to said body, up to a height difference of substantially 25 centimeters between said step members.

9. The device of claim 1, wherein said step members are five in number.

10. The device of claim 1, wherein the device is collapsible.

11. A device for ascent and descent of stairs, comprising:

(a) a plurality of substantially longitudinal step members arranged adjacent to each other;

(b) a plurality of posts pivotally attached to each of said step members, said posts being of varying lengths and being situated according to their length; and (c) an actuator for displacing said posts to and from an angle substantially vertical to the step member on which the device is situated.

12. The device of claim 11, wherein said actuator is a handle for manually displacing said step members.

13. The device of claim 11, further comprising a controller attached to said device.

14. The device of claim 11, wherein said actuator is electrically operated.

15. The device of claim 11, further comprising a transverse rail above the step members.

16. The device of claim 11, further comprising a rail parallel to said step members and set above an end of said device.

17. A device for providing stairs of variable step-height, the device comprising:

(a) at least three step members arranged side-by-side in abutting relation; and (b) an elevator mechanism associated with each of said step members, said elevator mechanism being configured to displace at least two of said step members vertically in a substantially continuously variable manner such that, at any given moment, said at least three step members form a set of non-overlapping stairs with a substantially continuously variable uniform step-height.

* * * * *